United States Patent [19]

Jacquot

[11] Patent Number: 4,780,642

[45] Date of Patent: Oct. 25, 1988

[54] ELECTRON CYCLOTRON RESONANCE ION SOURCE WITH COAXIAL INJECTION OF ELECTROMAGNETIC WAVES

[75] Inventor: Bernard Jacquot, Saint Egreve, France

[73] Assignee: Commissariat a l'Energie Atomique, Paris, France

[21] Appl. No.: 21,124

[22] Filed: Mar. 3, 1987

[30] Foreign Application Priority Data

Mar. 13, 1986 [FR] France ..... 86 03583

[51] Int. Cl.[4] ..... H01J 33/02; H05H 1/02

[52] U.S. Cl. ..... 313/359.1; 313/362.1; 250/425; 315/111.81

[58] Field of Search ..... 313/359.1, 362.1, 231.01, 313/231.31; 250/288, 425; 315/111.71, 111.81, 111.91

[56] References Cited

U.S. PATENT DOCUMENTS 3,924,134 12/1975 Uman et al. ..... 313/362.1 X
4,582,997 4/1986 Jacquot ..... 250/425
4,631,438 12/1986 Jacquot ..... 313/359.1

FOREIGN PATENT DOCUMENTS 0104109 3/1984 European Pat. Off. .
0142414 5/1985 European Pat. Off. .
2551302 3/1985 France .

OTHER PUBLICATIONS

Nuclear Instruments & Methods in Physics Research, section B, B10/11, No. 1, part 2, May 1985, pp. 775–778, Elsevier Science Publishers B.V., Amsterdam, NL; C. M. Lyneis: "Performance of the LBL ECR ion source".

Nuclear Instruments & Methods in Physics Research, vol. 219, No. 1, Jan. 1984, pp. 1–4, Elsevier Science Publishers B.V., Amsterdam, NL; R. Geller et al.: "Production d'ions calcium dans la source d'ions multicharges ECR minimafios".

*Primary Examiner*—David K. Moore
*Assistant Examiner*—Sandra L. O'Shea

[57] ABSTRACT

Electron cyclotron resonance ion source having an enclosure containing a plasma of ions and electrons formed by electron cyclotron resonance from a sample. The enclosure is connected to a transition cavity by a first conductive duct, and by a second conductive duct traversing the cavity and the first duct. The sample is introduced into the enclosure by the second duct, and the cavity is laterally connected to a vacuum source and to an electromagnetic wave generator by a tight, transparent window.

14 Claims, 4 Drawing Sheets

ELECTRON CYCLOTRON RESONANCE ION SOURCE WITH COAXIAL INJECTION OF ELECTROMAGNETIC WAVES

BACKGROUND OF THE INVENTION

The present invention relates an electron cyclotron resonance ion source with coaxial injection of electromagnetic waves, more particularly making it possible to produce multicharged ions.

It has numerous applications as a function of the different values of the kinetic energy of the ions produced, in the field of ion implantation, micro etching and more particularly in particle accelerator equipment used in both the scientific and medical fields.

In electron cyclotron resonance ion sources, the ions are obtained by ionization in a sealed enclosure, such as an ultra-high frequency cavity, of a gaseous medium constituted by one or more metal vapours or gases using electrons greatly accelerated by electron cyclotron resonance.

Electron cyclotron resonance is obtained through the combined action of a high frequency electromagnetic field injected into the enclosure and an axial symmetry magnetic field created in the enclosure. This axial magnetic field, which has an amplitude increasing from the centre of the enclosure towards its ends, has in particular an amplitude $B_r$ satisfying the electron cyclotron resonance condition $B_r f.2\pi m/e$ in which e represents the charge of an electron, m its mass and f the frequency of the electromagnetic field. This axial magnetic field is generally created by solenoids or magnetic coils surrounding the enclosure.

In this type of ion source, the quantity of ions which can be produced results from the competition between two processes, on the one hand the formation of the ions by electron impact on neutral atoms constituting the gaseous medium to be ionized and on the other hand by the destruction of these same ions by recombination during a collision of said ions with a neutral atom. This neutral atom can come from atoms of the gaseous medium which have not yet been ionized, or can be produced by the impact of an ion on the walls of the enclosure.

To minimize the destruction of the ions formed, the latter are confined in the enclosure, together with the electrons used for the ionization of the neutral atoms, thereby reducing collisions of the ions and electrons with the enclosure wall. For this purpose, within said enclosure is formed a radial magnetic field, which is superimposed on the axial magnetic field. The superimposing of these magnetic fields defines in the enclosure at least one closed "equimagnetic" surface having no contact with the enclosure walls. This surface represents the location of the points where the amplitude of the magnetic fields has the same value.

The radial magnetic field is in particular produced by magnetized bars arranged symmetrically around the enclosure and each constituted by several joined elementary magnets.

FIGS. 1*a* and 1*b* diagrammatically represent an example of a known electron cyclotron resonance ion source, which is described in FR-A-2 553 574, filed on Oct. 17, 1983 by the same Applicant. This ion source comprises an enclosure 2 within which a high vacuum has been formed, said enclosure constituting a resonant cavity which can be excited by a high frequency electromagnetic field. The latter is produced by an electromagnetic wave generator 3, such as a Klystron supplied with current by a power supply 6. This field is introduced into enclosure 2 by a wave guide 4, such as a metal duct.

This ion source also comprises means 10, indicated in mixed line form, making it possible to produce an axial magnetic field and a radial magnetic field within enclosure 2. These magnetic fields make it possible to define an equimagnetic closed surface 11.

In order to ionize a gas, the latter is introduced into enclosure 2 by a duct 8. The association of the axial magnetic field and the electromagnetic field makes it possible to highly ionized the gas introduced into the enclosure. The electrons produced are then highly accelerated by electron cyclotron resonance, which leads to the formation of a plasma of hot electrons confined in surface 11.

In the case where ions are produced from a solid and in particular a metallic sample 12, the latter is fixed to a support 14 in enclosure 2, in the vicinity of surface 7. Solid sample 12 is firstly vaporized and the vapours obtained are ionized, as in the case of a gas. As described hereinbefore, a hot electron plasma forms in the surface 11.

The vaporization of the solid sample is due to the interaction of the hot plasma with the sample. On starting of the vaporization reaction, the hot plasma necessary can be produced by ionizing a gas introduced into enclosure 2 by duct 8. This gas is solely injected to start of the vaporization reaction and the hot plasma necessary for maintaining the vaporization reaction then being obtained from the actual solid sample.

No matter what type of sample is used, the ions formed in the enclosure are extracted therefrom, e.g. by an extraction electric field generated by a potential difference created between a revolution electrode 16 and enclosure 2, electrode 16 and the enclosure 2 being connected to a power supply 17.

In order to obtain a constant intensity ion current, the latter is regulated by a regulating and control device.

FIGS. 1*a* and 1*b* respectively show an embodiment of the control and regulating device, which comprises means 18 using an electric and/or magnetic field for analysing the ions from enclosure 2. This device also comprises a motor 20, connected via a rod 22 to support 14 of solid sample 12, making it possible to slowly displace the latter in such a way that it intercepts in an optimum manner the plasma confined in surface 11. The more the solid sample 12 penetrates the enclosure 2, the higher its temperature and vaporization level.

This device also comprises a pulse generator 24 connected to the power supply 6. By adjusting the cycle, i.e. the ratio between the duration of a pulse and the pulse period, this pulse generator makes it possible to control the power supply 6 supplying the electromagnetic wave generator 3. Thus, the control of the mean power of the electromagnetic field is obtained by pulsating it.

Moreover, for regulating the ion current leaving enclosure 2, the total pressure in the enclosure must be kept constant. Total pressure measuring means 28 connected to enclosure 2, such as a pressure gauge make it possible via an appropriate means to ensure the operation of a valve 26 connected to the gas introduction duct, so that the total pressure in the enclosure remains constant. The appropriate means can, as shown in FIG.

1a, be a comparator 30 or, as shown in FIG. 1b, a microprocessor 32.

Comparator 30 is connected to means 28 and to valve 26, a reference voltage R being applied to said comparator.

Microprocessor 32 is connected to means 34 for measuring the intensity of the extracted ion current, to means 28, to valve 26, to motor 20 and to pulse generator 24. Thus, said microprocessor 32 permits an automatic regulation of the ion current.

FIGS. 2a and 2b diagrammatically show a known device making it possible to produce multicharged ions through a shielded magnetic structure. This shield makes it possible to only magnetize the volume useful for electron cyclotron resonance in enclosure 1. The device shown in FIGS. 2a and 2b is described in EP-A-O 138 642 filed on Aug. 17, 1984 in the name of the same Applicant.

This device comprises permanent magnets 35 fixed to the inner wall of a cylinder 37 of a ferromagnetic material, solenoids 39 arranged on either side of cylinder 37 and a magnetic shield 41. A material 43 makes it possible to magnetically isolate cylinder 37 from shield 41.

The permanent magnets 35 distributed in accordance with the circular section of cylinder 37 (FIG. 2a) can be quadripolar, hexapolar, octopolar, etc (FIG. 2b). These permanent magnets realise a multipolar radial magnetic field 45, whilst coils 39 supply and axial magnetic field 49. the superimposing of these two magnetic fields produces a closed equimagnetic surface 11.

Such a known device makes it possible to obtain a magnetically shielded, opaque ion source, whose magnetic axis 50 coincides with that of solenoids 39 and cylinder 37. This magnetic axis 50, which is also the longitudinal axis of the device, traverses shield 41 through two openings 51, 53 made therein, so as to permit on the one hand the extraction of ions from enclosure 1 and on the other hand the introduction of electromagnetic waves and the introduction of the sample into enclosure 1.

The axial injection of the electromagnetic waves into the enclosure causes certain problems. Thus, there is no magnetic field upstream of enclosure 1 level with axial opening 53. This absence of a magnetic field does not make it possible to easily guide the electromagnetic waves towards enclosure 1, as in the case of the attached FIGS. 1a and 1b, where the electromagnetic waves enter the enclosure in a relatively uniform magnetic field.

Moreover, at axial opening 53 located in the magnetic shield, the electromagnetic waves must pass through a resonance zone, where the modulus of the magnetic field passes suddenly from a zero value to a maximum value.

Moreover, the longitudinal axis 50 of enclosure 1 is not available as a result of the axial introduction of the electromagnetic waves. Thus, it is not possible to directly associate with said ion source a device for controlling and regulating the extracted ion current, as described relative to FIGS. 1a and 1b.

The object of the present invention is consequently to obviate these disadvantages by providing an ion source with coaxial injection, comprising a transition cavity and a group of ducts making it possible to guide the electromagnetic waves towards to enclosure and to inject them into the latter along its longitudinal axis, whilst still leaving said axis available.

SUMMARY OF THE INVENTION

The present invention more specifically relates to an electron cyclotron resonance ion source comprising an enclosure having a longitudinal axis, first and second opposite openings oriented in accordance with said axis, said enclosure containing a plasma of ions and electrons formed by electron cyclotron resonance from a sample, the first opening being connected to a system for extracting the ions from the enclosure and the second opening permitting the introduction of the sample and the high frequency electromagnetic waves produced by an electromagnetic wave generator and an externally shielded magnetic structure surrounding the enclosure and producing within the latter a radial magnetic field and an axial magnetic field, said fields making it possible to confine said plasma in the enclosure, wherein it also comprises a transition cavity connected to means for forming a vacuum having first and second opposite openings oriented along the longitudinal axis of the enclosure, the first opening of the cavity and the second opening of the enclosure being connected by a first conducting duct and the second opening of the cavity and the second opening of the enclosure being connected by a second duct, which is at least partly conductive and which traverses the cavity and the first duct, the electromagnetic wave generator being connected to the cavity by a wave guide, a vacuum-tight window transparent to the electromagnetic waves being placed between the cavity and the wave guide, the latter being at atmospheric pressure.

The transition cavity according to the invention has a random shape and can in particular be cubic. In this case the electromagnetic waves penetrate the cavity laterally, the axial sides of the cavity being connected to the enclosure by first and second ducts.

The first and second openings of the cavity respectively have the dimensions of the sections of the first and second ducts. The cavity window is preferably of BeO, but it is also possible to use other materials such as $Al_2O_3$.

According to an embodiment of the invention, with the sample being gaseous, the latter is introduced into the enclosure by the second duct from the second opening of the cavity.

Advantageously, with the sample gaseous, one end of said second duct adjacent to the second opening of the enclosure is transparent to the electromagnetic waves, at least in that part of the second duct facing the shield of the magnetic structure.

The transparent part of the second duct can e.g. be produced by fitting an e.g. $Al_2O_3$ transparent duct to a duct having a length less than that of the second duct.

According to a constructional variant of the invention, with the sample solid, the latter is introduced into the enclosure in the form of a rod at least traversing the second duct.

Rod is understood to mean both a filamentary sample and a bar. Said rod can either be metallic for producing ions of the metal used, or dielectric. Thus, for example with dielectric samples, such as sample of $Al_2O_3$, $SiO_2$ and $CaF_2$, Al, Si and Ca ions are respectively produced.

The length of the rod is not defined and it can constitute an important sample reserve for long ionization cycles. However, the rod preferably has a length which exceeds that of the second duct, so that it can penetrate the enclosure and can also be positioned in that latter.

According to an embodiment of the ion source, it comprises a device for controlling and regulating the extracted ion current.

When the sample is gaseous, the device for controlling and regulating the extracted ion current comprises means used for modifying the gas flow rate introduced into the second duct, such as a valve associated with gas introduction ducts and means for controlling the means used for modifying the gas flow rate.

According to a variant, the device for controlling and regulating the extracted ion current when the sample is solid comprises means for positioning the solid sample on the longitudinal axis of the enclosure.

The means for controlling the valve e.g. comprise a comparator or a microprocessor associated with means for measuring the total pressure of the enclosure. Furthermore, the means for positioning the solid sample in the enclosure comprise a motor which can be controlled by the microprocessor. The latter can also be used for controlling the electromagnetic wave generator.

According to another embodiment of the the ion source, it comprises a device for regulating the internal volume of the transition cavity. Preferably, said device comprises a piston located in a third opening formed in the transition cavity.

The position of the piston is regulated prior to the use of the ion source for producing ions. This piston is positioned in such a way that the vacuum volume of the transition cavity maximizes the transmission of electromagnetic waves towards the enclosure containing the plasma by means of the first and second ducts. These wave are then guided in accordance with a coaxial mode by the inner wall and outer wall respectively of the first and second ducts up to the plasma in the enclosure.

Preferably, the cavity, the first duct and at least part of the second duct are made from copper. However, obviously, other non-magnetic conductive materials, such as Al alloys or stainless steel can also be suitable for guiding the electromagnetic waves. These electromagnetic waves are generally guided over short distances of approximately 1 dm.

Advantageously, for electromagnetic waves of frequency 10 GHz, the ratio between the internal diameter of the first duct and the external diameter of the second duct is between 3 and 5. For example, the first duct has an internal diameter of 25 mm and an external diameter of 30 mm and the second duct has an internal diameter of 4 mm and an external diameter of 6 mm. These two ducts provide a coaxial line with a characteristic impedance of approximately 85Ω.

According to another preferred embodiment of the invention, the external diameter of the first duct is of the same order of magnitude as the thickness of the shield of the magnetic structure of the ion source. This permits an effective magnetic shielding by a simple magnetic casing.

BRIEF DESCRIPTION OF THE DRAWINGS

The invention is described in greater detail hereinafter relative to non-limitative embodiments and the attached drawings, wherein show.

DETAILED DESCRIPTION OF THE PREFERRED EMBODIMENTS

Figure 1A:
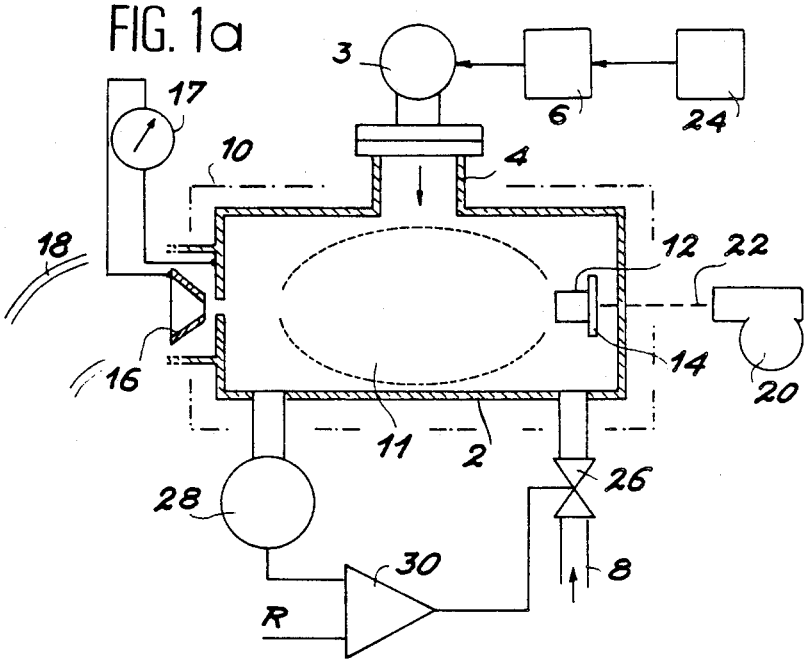
PRIOR ART FIG. 1a
FIGS. 1*a* and 1*b* diagrammatically a prior art cyclotron resonance ion source.
Figure 1B:
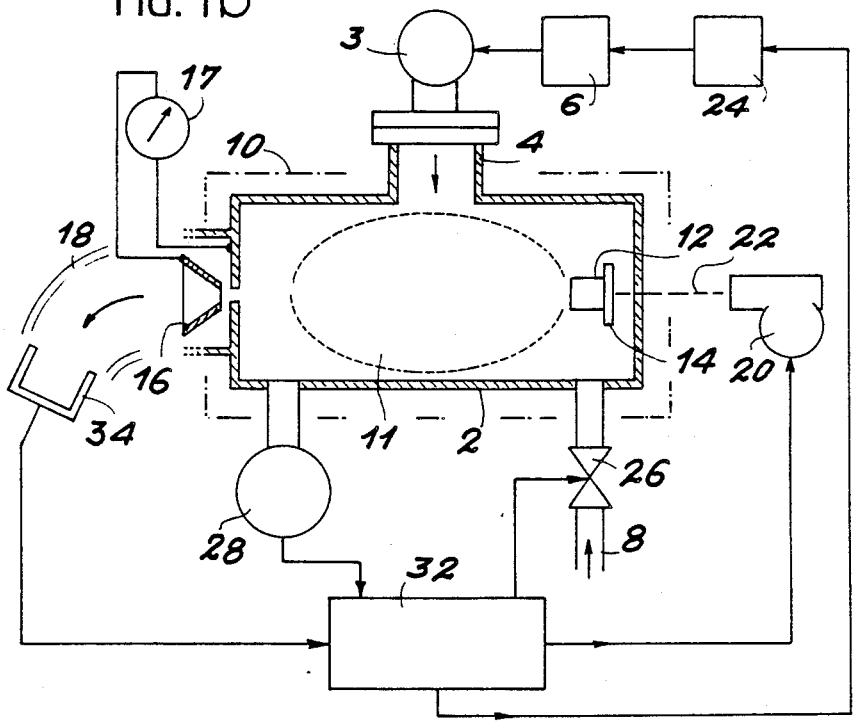
PRIOR ART FIG. 1b
Figure 2A:
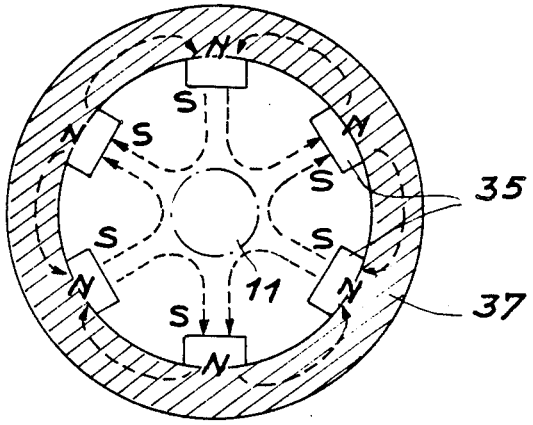
PRIOR ART FIG. 2a
FIGS. 2*a* and 2*b* a prior art device for producing multicharged ions through a shielded magnetic structure.
Figure 2B:
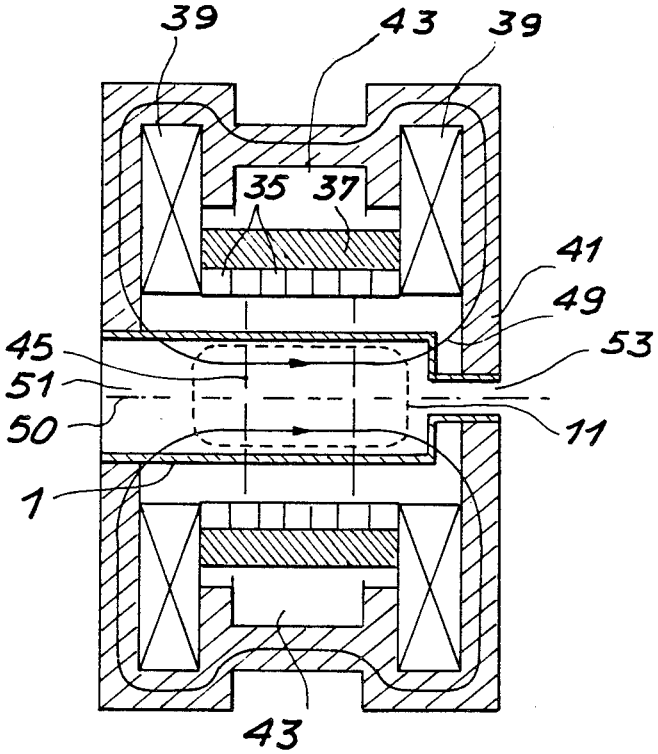
PRIOR ART FIG. 2b
Figure 3:
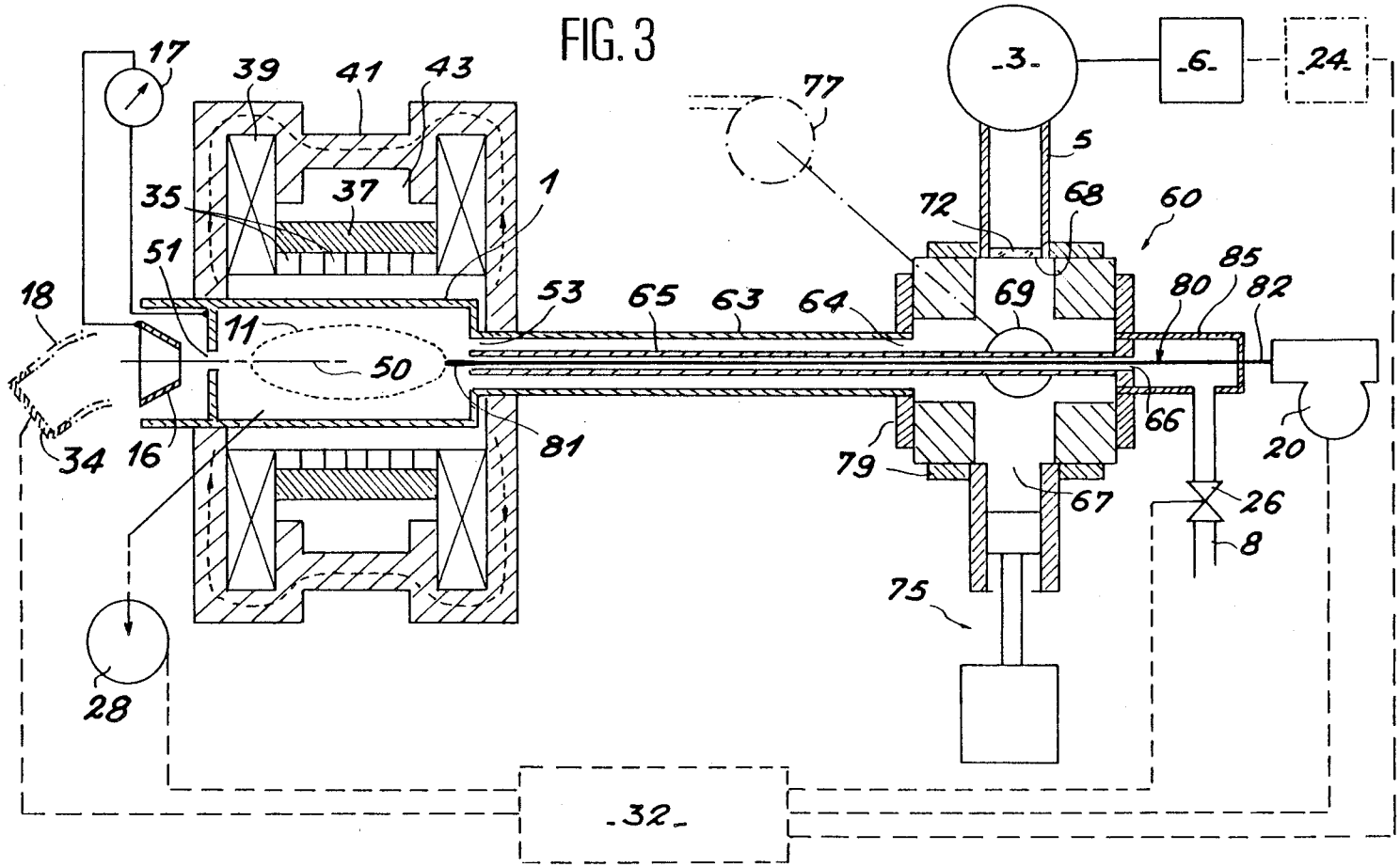
FIGS. 3, diagrammatically, an embodiment of an ion source according to the invention for a solid sample, and FIG. 4, diagrammatically a constructional variant of an ion source according to the invention for a gaseous sample.
Figure 4:
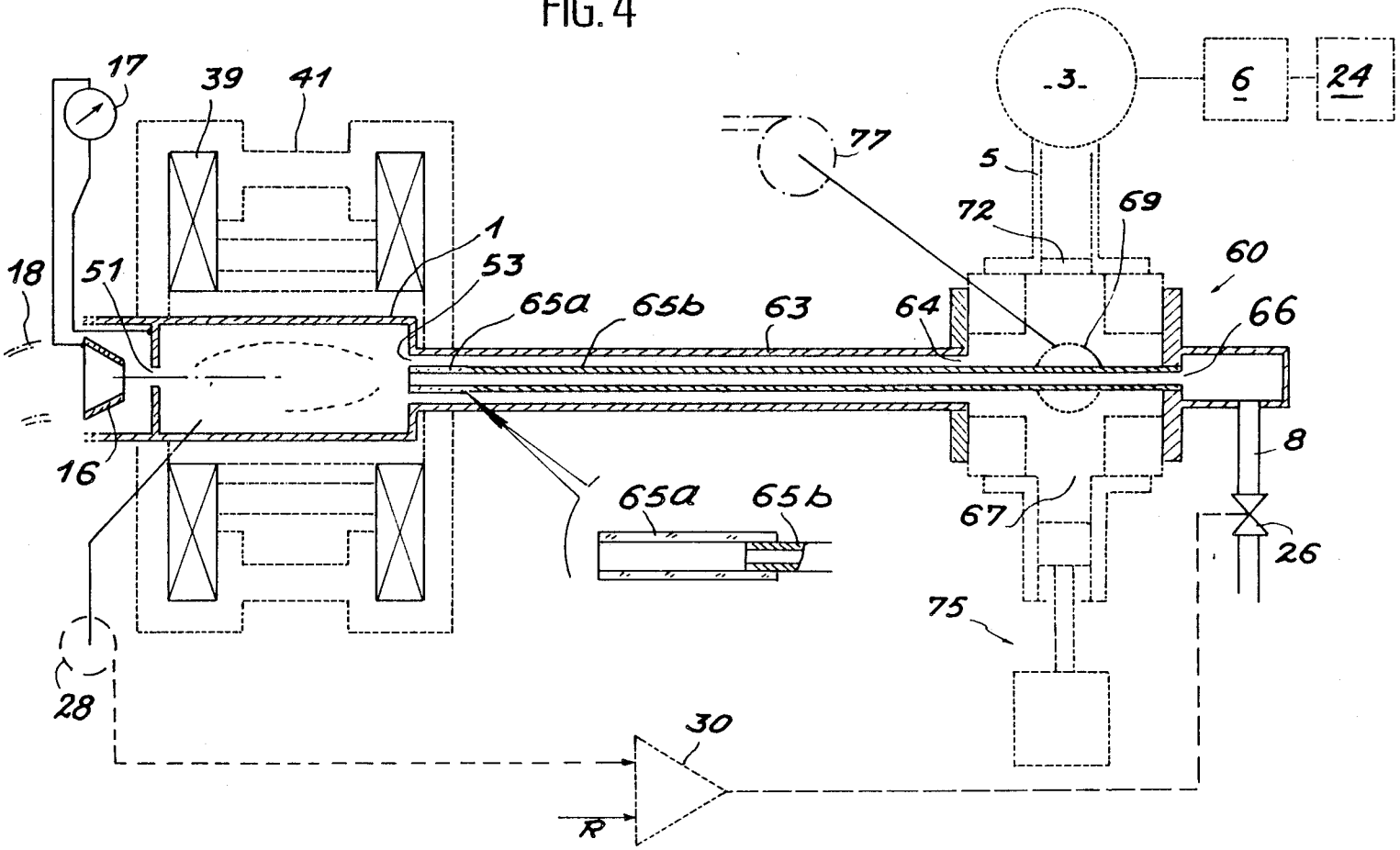

The elements of FIGS. 3 and 4, which are common to the prior art and have already been described relative to FIGS. 1*a*, 1*b*, and 2*a*, 2*b*, carry the same references as in the latter and will not be described again.

FIG. 3 has the enclosure 1 described relative to FIG. 2b and within which there are a radial magnetic field 45 and an axial magnetic field 49. This enclosure is surrounded by a shielded magnetic structure of the same type as that described relative to FIG. 2*b*.

The ion source shown in FIG. 3 also comprises a transition cavity 60 connected to opening 53 of enclosure 1 by first and second ducts 63, 65. As shown in FIG. 3, said cavity is e.g. realised in a metallic cube. The two faces of the cube, which are normal to the longitudinal axis 50 of enclosure 1, as well as three of the lateral faces of the cube are respectively provided with openings 64, 66, 67, 68 and 69.

Duct 63 connects the opening 64 of cavity 60 to opening 53 of enclosure 1. These two openings 64, 53 have the dimensions of the section of duct 63. Moreover, duct 65 connects openings 66 of the cavity to opening 53 of the enclosure. Said duct 65 traverses cavity 60 and duct 63. Opening 66 of cavity 60 has the dimensions of the section of duct 65.

One of the lateral openings 68 of the cube is connected by a wave guide 5, such as a metal duct, to the high frequency electromagnetic wave generator 3 described hereinbefore. A vacuum-tight window 72 transparent to the high frequency electromagnetic waves is inserted between the cavity and the wave guide, the latter being at atmospheric pressure. This generator 3 is supplied with power from power supply 6.

Another lateral opening 67 of the cavity is connected to a device 75 e.g. comprising a piston, for regulating the internal volume of the cavity and the third lateral opening 69 of the cavity is connected to means 77 for forming the vacuum, such as a turbomolecular drag pump, e.g. of 50 l/s.

These different openings 64, 66, 67, 68, 69 are produced e.g. by perforating a metal mass along three orthogonal axes. The adjustment between the dimensions of the openings made during perforation and the dimensions of the necessary openings is e.g. carried out by metal plates 79 tightly fixed to the perforated faces of said mass.

For electromagnetic waves of 10 GHz, use is e.g. made of a duct 63 with an external diameter of 30 mm and an internal diameter of 25 mm, as well as a duct 65 of external diameter 6 mm and internal diameter 4 mm. Opening 64, 66 of the cavity are consequently adjusted by plates 79, so as to obtain openings which are matched to said ducts.

The ratio of the diameters of these two pipes makes it possible to consider the latter as a coaxial line with a characteristic impedance of approximately 85Ω. Moreover, the space between these two ducts permits an adequate pumping of said space by means 77.

Moreover, prior to the use of the ion source the position of piston 75 is regulated in order to tune all the internal volumes of cavity 6 and the coaxial line to the frequency of the electromagnetic waves used for obtaining a minimum of reflected waves. A reflected wave is a wave returning to the electromagnetic wave generator.

When these internal volumes are tuned to the frequency of the electromagnetic waves, the electromagnetic waves injected into the cavity are almost entirely transmitted to the enclosure 1 containing the plasma and are then absorbed in the equimagnetic surface 11 of enclosure 1.

When it is wished to produce ions from a solid sample, the latter is introduced in the form of a rod 80 into duct 65. The end 81 of the rod located in enclosure 1 is positioned in the vicinity of surface 11.

Moreover, when it is wished to produce ions from a gas, particularly for starting the vaporization reaction of a solid sample, the gas is introduced into duct 65, e.g. by a duct 85 connected to the cavity opening 66 and by duct 8 laterally connected to duct 85. The end of duct 85 opposite to cavity opening 66 is closed to leave axis 50 available.

Due to the fact that the longitudinal axis 50 of the ion source according to the invention is free in the vicinity of the sample introduction opening 66, it is possible to associate therewith a device for controlling and regulating the current of extracted ions of the type described relative to FIGS. 1*a* and 1*b*.

FIG. 3 shows the embodiment of the control and regulating device described relative to FIG. 1*b* having a microprocessor 32 connected to means 34 for measuring the intensity of the extracted ion current, to means 28 for measuring the total pressure of the enclosure, to a valve 26 connected to the gas introduction duct 8, to a motor 20 connected to the end 82 of rod 80 and to a pulse generator 24 connected to the power supply 6 of the electromagnetic wave generator 3. In the case where duct 85 is connected to cavity opening 66, the rod end 82 traverses said duct 85 along its axis, so as to be connected to motor 20.

FIG. 4 shows a constructional variant of the ion source according to the invention making it possible to produce ions from a gas. It is also possible to see another embodiment of a device for controlling and regulating the extracted ion current described relative to FIG. 1*a* associated with the ion source according to the invention.

In FIG. 4, rod 80 and motor 20 making it possible to position the rod in the enclosure are not shown. In addition, the second duct 65*a*, 65*b* differs from that of the ion source shown in FIG. 3 by an end 65*a* transparent to the electromagnetic waves in the vicinity of the enclosure opening 53 facing the magnetic structure shield 41. This material which is transparent to high frequency electromagnetic waves is e.g. $Al_2O_3$. End 65*a* is generally in the form of a transparent tube fitted onto a duct 65*b* of the same type as duct 65 shown in FIG. 3, but shorter than the latter.

A pre-ionization of the gas introduced into the second duct takes place in the inner volume of the transparent end 65*a* of said duct. Thus, within said volume there is an axial magnetic field from the solenoids, an electromagnetic field and a high gas pressure. The electromagnetic field comes from the electromagnetic waves guided between the first duct 63 and the non-transparent part 65*b* of the second duct and transmitted by end 65*a* of the second duct. Therefore, electron cyclotron resonance takes place within end 65*a* of the second duct in a volume where there is a high gas pressure. The denser the plasma produced by electron cyclotron resonance within end 65*a*, the better the coaxial guidance of the electromagnetic waves, said dense plasma line even becoming conductive. Moreover, said plasma line has the same external diameter as part 65*b* of the second duct. The characteristic impedance of the coaxial line is consequently not modified. This makes it possible to prevent the reflection of electromagnetic waves.

Thus, this end which is transparent to the electromagnetic waves constitutes an auto-regulated pre-ionization stage, where the excess incident power of the electromagnetic waves is transmitted without reflection to the electron cyclotron resonance zone located in the equimagnetic surface 11.

The device for controlling and regulating the extracted ion current shown in this drawing has a comparator 30 connected on the one hand to means 28 for measuring the total pressure of the enclosure and on the other hand to a valve 26 connected to the gas introduction duct 8, a reference voltage R also being applied to said comparator. The device also comprises a pulse generator 24 connected to the power supply 6 of electromagnetic wave generator 3.

Obviously, the devices for controlling and regulating the extracted ion current shown in FIGS. 3 and 4 can be associated with any of the two embodiments of the ion sources according to the invention.

In the case where the control and regulating device shown in FIG. 4 is associated with a source of ions produced from a solid sample 80, a manually regulated motor 20 is connected to said sample.

Cavity 60, metal plate 79 and ducts 63, 65, 65*b* are preferably of copper, but it is obviously possible to use other conductive materials. Moreover, window 72 is made from a material which is vacuum-tight and transparent to high frequency electromagnetic waves, said material being BeO or $Al_2O_3$.

The ion source according to the invention has a certain number of specific advantages which will be referred to hereinafter.

The coaxial injection of electromagnetic waves between the first duct 63 and the second duct 65, 65*a*, 65*b* makes it possible not to disturb the propagation of these waves from the magnetic shield 41. Thus, the transmission of these waves takes place with substantially no reflection or energy absorption.

Moreover, the use of a transition cavity for injecting the electromagnetic waves makes it possible to free the end of the second sample introduction duct 65, 6*b*. Therefore a device for controlling and regulating the extracted ion current can be associated with the ion source according to the invention.

Moreover, the use of a small diameter duct 63 which is of the same order of magnitude as the thickness of the magnetic shield 41 which it traverses, makes it possible to maintain a simple magnetic shield. The simplicity of this shield facilitates the high voltage isolation or insulation of the ion source and permits an easy disassembly thereof and particularly of the enclosure (enclosure 1 generally being integral with duct 63). It is therefore easy to clean the ion source, so that high intensity metal ions can be produced continuously for long periods (such ions generally making the ion source dirty).

Moreover, any random solid sample can be introduced into enclosure 1 through the second duct 65 without disturbing or modifying the setting of the piston, as a result of the passage through the cavity via said metal duct.

Another advantage of the ion source according to the invention is the position of window 72 outside any magnetic field and therefore the plasma. This obviates any pollution of the window 72, e.g. by metallic elements from the plasma.

What is claimed is:

1. An electron cyclotron resonance ion source comprising:

an electromagnetic wave generator;

a system for extracting ions;

an enclosure having a longitudinal axis, first and second opposite openings oriented in accordance with said axis, said enclosure containing a plasma of ions and electrons formed by electron cyclotron resonance from a sample, said first opening being connected to said system for extracting ions from the enclosure, said second opening permitting introduction of the sample and of high frequency electromagnetic waves produced by said electromagnetic wave generator;

an externally shielded magnetic structure surrounding said enclosure and producing within the latter a radial magnetic field and an axial magnetic field, said fields confining said plasma in said enclosure;

means for forming a vacuum;

a transition cavity connected to said means for forming a vacuum, and having first and second opposite openings oriented along the longitudinal axis of said enclosure;

a first conducting duct for connecting said first opening of said cavity and said second opening of said enclosure;

a second duct for connecting said second opening of said cavity and said second opening of said enclosure, said second duct being at least partly conductive and traversing said cavity and said first duct;

a wave guide for connecting said electromagnetic wave generator to said cavity; and a vacuum-tight window transparent to the electromagnetic waves and placed between said cavity and said wave guide.

2. An ion source according to claim 1, wherein the sample is a gaseous sample introduced into said enclosure by said second duct from said second opening of said cavity.

3. An ion source according to claim 1, wherein the sample is a gaseous sample, and one end of said second duct adjacent to said second opening of said enclosure is transparent to the electromagnetic waves, at least in a part of said second duct which faces the shielded magnetic structure.

4. An ion source according to claim 1, wherein the sample is a solid sample introduced into the enclosure in the form of a rod, and at least traversing said second duct.

5. An ion source according to claim 1, comprising a device for controlling and regulating the extracted ions.

6. An ion source according to claim 5, wherein the sample is a gaseous sample, and said device comprises means for modifying the flow rate of the gaseous sample introduced into said second duct, and means for controlling said means for modifying the flow rate.

7. An ion source according to claim 5, wherein the sample is a solid sample, and said device comprises means for positioning the solid sample on the longitudinal axis of said enclosure.

8. An ion source according to claim 1, comprising a device regulating the volume of said transition cavity.

9. An ion source according to claim 8, wherein said device comprises a piston located in a third opening in said transition cavity.

10. An ion source according to claim 1, wherein said transition cavity is made from copper.

11. An ion source according to claim 1, wherein said first duct is made from copper.

12. An ion source according to claim 1, wherein said second duct is at least partly made from copper.

13. An ion source according to claim 1, wherein the electromagnetic waves have a frequency of 10 GHz, and the ratio between the internal diameter of said first duct and the external diameter of said second duct ranges between 3 and 5.

14. An ion source according to claim 1, wherein the external diameter of said first duct is of the same order of magnitude as the thickness of said shielded magnetic structure.

* * * * *